United States Patent [19]

Otaki et al.

[11] Patent Number: 4,765,917

[45] Date of Patent: Aug. 23, 1988

[54] WATER-BASE METAL FORMING LUBRICANT COMPOSITION

[75] Inventors: Shiro Otaki, Tokyo, Japan; Edmond J. Stoutenburg, Port Huron, Mich.

[73] Assignee: Acheson Industries, Inc., Port Huron, Mich.

[21] Appl. No.: 914,009

[22] Filed: Oct. 1, 1986

[51] Int. Cl.[4] ..... C10M 129/52; C10M 173/02

[52] U.S. Cl. ..... 252/40.7; 252/40.5; 252/42; 252/42.1; 252/49.3

[58] Field of Search ..... 252/40.7, 49.3, 42.1

[56] References Cited

U.S. PATENT DOCUMENTS

| | | | |
|---|---|---|---|
| 2,937,993 | 5/1960 | Pattenden | 252/41 |
| 2,959,547 | 11/1960 | Brillhart | 252/42.1 |
| 3,983,042 | 9/1976 | Jain et al. | 252/25 |
| 4,401,579 | 8/1983 | Kratzer | 252/41 |
| 4,402,839 | 9/1983 | Davis et al. | 252/49.3 |
| 4,409,113 | 10/1983 | Bertell | 252/42 |
| 4,454,050 | 6/1984 | Bertell | 252/41 |
| 4,533,481 | 8/1985 | Jahnke | 252/49.3 |

OTHER PUBLICATIONS

Smalheer and Smith, "Lubricant Additives", 1967, pp. 9–10.

*Primary Examiner*—William R. Dixon, Jr.
*Assistant Examiner*—Ellen McAvoy
*Attorney, Agent, or Firm*—Harness, Dickey & Pierce

[57] ABSTRACT

A new water-base lubricant composition has been discovered which is uniquely suitable for elevated temperature metal forming operations. The water-base lubricant invention herein generally comprises, about 1% to about 40% by weight of a polycarboxylic acid salt reaction product, such as trimellitic acid and an alkali metal or an alkali earth metal hydroxide, such that the pH of the composition is about 6.5 to about 10; about 0.1% to about 12% by weight of a water dispersible thickening agent; and the balance water. The water-base lubricant may also include extreme pressure additives, performance enhancers, and biocidal agents. Also disclosed is a process for using the above-described water-base lubricant composition.

11 Claims, No Drawings

WATER-BASE METAL FORMING LUBRICANT COMPOSITION

BACKGROUND OF THE INVENTION

Over the past several years, environmental and ecological problems associated with oil-base hot forging lubricants have lead to a serious need for more desirable and workable water-base lubricating compositions for use in hot forgings. Past attempts directed to water-base compositions have involved the use of materials such as graphite, clay minerals, iron oxide, and molybdenum disulfide. These attempts, however, have in many instances not been fully satisfactory for any one of numerous reasons. One of such reasons is the inability to properly lubricate the forging die under actual operating procedures involving very hot or elevated temperature conditions. Another reason is that the presence of water in the composition often times does not adequately wet the metal surface involved. Still another reason is the improper working of some prior water-base lubricants at elevated temperatures. Thus, there has been a need in the field for a water-base lubricant which will provide improved lubrication and wetting of a hot forging die at elevated temperatures.

The state of the art is indicated by the following cited references. U.S. Pat. Nos.: 3,983,042 to Jain et al; 2,937,993 to Pattenden et al; 2,940,930 to Pattenden et al; 2,898,296 to Pattenden et al; 3,985,662 to Campbell et al; 2,349,817 to Farmington et al; 3,929,651 to Murray et al; 3,507,791 to Teeter et al; 3,375,193 to Ruzza et al; 3,313,729 to Glasson; 2,921,879 to Kubie; 2,735,864 to Hodson Sr. et al; 4,401,579 to Kratzer; 4,454,050 to Bertell; 4,409,113 to Bertell; U.K. Application Publication No. 2,046,298A; British Pat. Nos. 721,255; 856,924; and 995,708. Bertell U.S. Pat. No. 4,450,050 discloses a lubricant composition which requires a combination of an aromatic polycarboxylic acid (phthalic acid) and an aliphatic polycarboxylic acid (adipic acid). Bertell teaches away from using anything other than such combinations.

Accordingly, a primary object of this invention is to provide a new and unique water-base lubricant composition which is highly useful as a lubricant material in elevated temperature metal forming operations.

Another object of the present invention is to provide such a composition wherein wetting temperatures on the metal forging surfaces are significantly higher, at comparable solid levels, than prior water-base lubricant compositions for hot metal forming.

Another object of the invention is to provide a new water-base lubricant composition which would provide reduced press loading during the metal forming operation.

Another object of the invention is to provide a new water-base lubricant composition which permits enhanced and superior metal movement during the elevated temperature metal forming operation.

Other objects, features, and advantages of the present invention will become apparent from the subsequent description and the appended claims.

SUMMARY OF THE INVENTION

It is not fully understood as to how and why the invention operates to provide the unique results and technical advantages that have been obtained. It has been found that when the water-base lubricant composition of this invention is applied to hot forging or hot forming dies, the result is outstanding lubricating, wetting and performance characteristics at elevated temperatures.

While the art has recognized that some water-base lubricant compositions provide hot forging dies with lubricating and wetting characteristics, it has been surprisingly discovered in this invention that a composition consisting essentially of an alkali salt of trimellitic acid (benzene 1,2,4-tricarboxylic acid), a water dispersible organic thickening agent and the balance water, exhibits markedly better results than were heretofore achieved.

In practice of the instant invention, the lubricant component of the water-base lubricating composition is trimellitic acid in the salt forms thereof, (that is an alkali metal or alkali earth metal hydroxide salt thereof), a water dispersible organic thickening agent, and the balance water. The alkali metal hydroxide is generally sodium hydroxide.

The organic thickening agent is generally selected from the group consisting of methyl cellulose, hydroxymethyl cellulose, hydroxyethyl cellulose, carboxypropyl cellulose, casein, alginates, polymethacrylates, polyvinyl alcohol, starch, gelatin, gum arabic, polysaccharides, and mixtures thereof.

Extreme pressure additives may also be included in the inventive composition, such as those selected from the group consisting of molybdenum disulfide, graphite, boron nitride, talc, calcium carbonate, mica, magnesium oxide, phosphate esters, sulfurized fatty acids, phosphosulfurized vegetable oil, metallic soaps, alkali stearates, alkali oleates, and mixtures thereof.

Performance enhancers may also be used in the composition, such as those selected from the group consisting of sodium nitrite, sodium nitrate, alkali-metal silicates, alkali-metal borates, alkali-metaborates, alkali-metal chlorides, alkali-metal fluorides, ammonium phosphates, alkali-metal polyphosphates, ammonium acetate, ammonium citrate, sodium benzoate, and mixtures thereof.

The water-base lubricant herein may also include a biocide or biocidal agent such as those selected from the group consisting of polyamino derivatives, triazine derivatives, and mixtures thereof. These agents prevent the growth of bacteria and germs, and also prevent biodegradation, in the composition.

The invention also includes a process for hot metal forging and forming utilizing the water-base lubricating composition discovered and disclosed herein. A ferrous or non-ferrous metal is contacted with the water-base lubricant composition of the present invention, the forging dies are closed thus forging the metal, the dies are opened and the forging is removed. The forming process is comprised of substantially similar steps as that of the forging process: contacting the metal with an effective lubricating amount of the water-base lubricating composition of the present invention and forming the metal.

DETAILED DESCRIPTION OF THE INVENTION

The water-base lubricant composition of the present invention in its most basic terms comprises, a lubricant component, an organic thickener agent, and the balance water.

The unique lubricant of the water-base lubricant composition is an aqueous solution of trimellitic acid salt. The trimellitic acid is combined with an alkali metal or alkali earth metal hydroxide in an amount generally sufficient to convert the trimellitic acid to its salt form. Generally, the molar ratio of the alkali metal hydroxide to trimellitic acid is about 3.2:1 to about 2.8:1, and preferably about 3:1. This ratio of alkali metal to trimellitic acid forms the lubricant reaction product of the present invention.

The trimellitic acid is employed in the water-base lubricant composition of the present invention at a level from about 2 to about 30% by weight, preferably about 5 to about 20% by weight, and highly preferred at a level of about 10 to about 15% by weight. The trimellitic acid is generally added to the alkali metal hydroxide in the form of trimellitic anhydride.

The percentage figures given herein are percent by weight of the overall lubricant composition unless otherwise specified.

The alkali metal hydroxide employed in the lubricant composition of the present invention is at a level from about 2 to about 30%, preferably about 5 to about 20%, and highly preferred at about 10 to about 15% by weight. The alkali metal hydroxide is preferably sodium hydroxide. The sodium hydroxide may be used in either a particulate form which is commercially available, or it may be added in the form of an aqueous solution.

The alkali metal hydroxide and trimellitic acid are combined together to form a trimellitic acid salt. The trimellitic acid salt employed in the water-base lubricant composition of the present invention is at a level of about 1 to about 40%, preferably about 2 to about 22%, and best results are at a level of about 10 to about 20% by weight of the total composition. The trimellitic acid salt forms the lubricant reaction product of the present invention and is the unique lubricating and releasing agent of the invention. The lubricant reaction product has a pH of about 6.5 to 10, preferably about 7 to 10, and best results are at a level of about 7 to 8.

The organic thickening agents employed in the composition of the present invention are at a level of about 0.1 to about 12%, preferably about 0.2 to about 5%, and highly preferred at a level of about 0.5 to about 2% by weight. The organic thickeners of the present invention are selected from the group consisting of modified cellulose such as methyl cellulose, ethyl cellulose, carboxyl methyl cellulose, ammonium carboxyethyl cellulose, hydroxymethyl cellulose, hydroxyethyl cellulose, carboxypropyl cellulose, and mixtures thereof. Other thickening agents which may be employed in the present invention are selected from the group consisting of casein, alginates, polymethacrylates, polyvinyl alcohol, starch, gelatin, gum arabic, polysaccharides, and mixtures thereof. The thickening agents assist in stabilizing the other components and assist in enhancing adhesion and wetting of the lubricant composition on the surface of the dies and/or the workpiece.

The extreme pressure additives employed in the water-base lubricant composition of the present invention are at a level of 0 to about 35%, preferably about 0.01 to about 22%, and highly preferred at about 1 to about 16% by weight. The extreme pressure additives enhance the forging under extremely high pressure conditions. The extreme pressure additives are selected from the group consisting of molybdenum disulfide, graphite, boron nitride, talc, calcium carbonate, mica, magnesium oxide, phosphate esters, sulfurized fatty acids, phosphosulfurized vegetable oils, metallic soaps, alkali stearates, alkali oleates, phosphate esters (e.g. GAFAC LP 700; obtained from General Aniline & Film, a 40:60 ratio mixture of monopolyethylene oxide phenyl ether phosphate and dipolyethylene oxide phenyl ether phosphate), and mixtures thereof. Preferably, the extreme pressure additives are selected from the group consisting of graphite, molybdenum disulfide, and phosphate esters and are employed at a level of about 0.01 to about 22%, and highly preferred at about 1 to about 16% by weight.

Another aspect of the discovery made in this invention is that the phosphate esters when used as the extreme pressure additives give even more markedly improved results for the lubricant composition herein. Suitable phosphate esters for use herein are identified by the following chemical materials trade names LP-700; GF-361; LE-700; and RM-510 (each of the above-identified phosphate ester materials are available from General Aniline & Film Corp.); and Ida-Sol W-305 (available from Ideas, Inc.).

The phosphate ester material for use in the composition herein should generally have the following properties:

| | |
|---|---|
| Specific Gravity (at 25° C.) | Approx. 1.0 to 1.7 |
| Acid Number | Approx. 30 to 200 |
| Phosphorous (% max.) | Approx. 1 to 16 |

The performance enhancers employed in the water-base lubricant composition of the present invention are at a level of 0 to about 15%, preferably about 0.01 to about 10%, and highly preferred at about 1 to about 5% by weight. The performance enhancers are selected from the group consisting of sodium nitrite, sodium nitrate, alkali-metal silicates, soluble alkali-metal borates, alkali-metaborates, alkali-metal chlorides, alkali-metal fluorides, ammonium phosphates, alkali-metal polyphosphates, ammonium acetate, ammonium citrate, sodium benzoate, and mixtures thereof. The performance enhancers aid the composition in film formation, insulation, increased temperature resistance, and surface wetting or cooling.

The biocides employed in the water-base lubricant composition of the present invention are at a level from 0 to about 5%, preferably about 0.01 to about 2%, and highly preferred at about 0.05 to about 1% by weight. The biocide or preservative agents are selected from the group consisting of polyamino derivatives, triazine derivatives, and mixtures thereof.

As is noted herein, additives such as organic thickeners, extreme pressure additives, performance enhancers, biocides, suspending agents, dispersing agents, wetting agents, corrosive inhibitors, pigments, dyes, and the like, may be used in the composition of this invention.

Aqueous lubricating compositions of the present invention are usually supplied in concentrate form. The lubricant composition may be employed in concentrate form for some difficult hot forging operations. In other somewhat less difficult hot forgings, the concentrated lubricant may be diluted with water to fit the particular forging needs. The amount of dilution can be determined by actual operation of the forging press on a particular workpiece. Satisfactory forgings have been made with up to a dilution ratio of 1:1 to 1:50 (volume ratio of the concentrated lubricant composition of the present invention to water).

The pH of the composition should be maintained within the broad range of about 6.5 to about 10, preferably from about 7 to about 10, and most preferably from about 7 to about 8.

The water-base lubricant composition of the present invention may be used in hot forging processes, and other metal forming operations, such as drawing, press forming, extrusion, wire drawing, and like processes where workpiece temperatures generally reach at least about 1100°-1300° F. for aluminum pieces, and 1300°-2300° F. (generally 1800°-2000° F.) for steel pieces. The average die temperature is about 600° F., however, the die temperature may vary from about 250° F. to 900° F.

The preferred method of application of the lubricant composition of the present invention is by spraying the composition on the surface of the dies or directly upon the workpiece, however, swabbing, dipping, or the like may also be employed.

The water-base lubricant composition is generally formed by mixing the trimellitic acid with the alkali metal hydroxide in the presence of water, forming a trimellitic acid salt.

In order to further illustrate the benefits and advantages of the present invention, the following specific examples are provided. It will be understood that the examples are provided for illustrative purposes and are not intended to be limiting of the scope of the invention as set forth in the subjoined claims.

EXAMPLE 1

In this example, stoichiometric amounts of 50% sodium hydroxide and trimellitic anhydride were reacted in an open vessel to give a solution of trisodium trimellitate in water.

The above solution was then placed into a small ball-mill, together with synthetic flake-graphite, a suitable cellulosic modifier and a silicate as a performance enhancer. This blend was then milled for a total of 16 hours and unloaded.

A suitable amount of water was added to adjust the final solids to 30%. The result was a stable, pourable fluid product with a Brookfield viscosity of 2000 cps at 72° F.

The formulation of the composition is as follows:

| Ingredient | % By Weight |
|---|---|
| Trimellitic Anhydride | 7.94 |
| Sodium Hydroxide | 5.41 |
| Water | 51.65 |
| | 65.00 |
| Graphite (Electric Furnace; 200 Mesh 99% through) | 9.00 |
| Carboxy Methyl Cellulose (7M Grade (Hercules) 0.8%) (7L Grade (Hercules) 0.7%) | 1.50 |
| Water | 23.50 |
| Sodium Silicate (K-Brand - Phil. Quartz Co.) | 1.00 |
| | 35.00 |
| | 100.00 |

The above composition was used in a severe operation of hot drawing steel casings (artillery shells). In preparing to run this test, two parts of water by weight were added to one part of the above composition and blended. The lubricant was spray applied to the hot punch or ram with good wetting. The press operated well with no sign of squealing which would indicate poor lubrication. As the punch became hotter as the operation continued, the lubricant continued to form a very good coating with minimal spraying.

The test parameters were as follows:

1. The ram was in contact with the billet approximately 11 seconds.
2. The typical cooling water application was on the ram for approximately 15-17 seconds.
3. The spray time with the lubricant varied between 8 and 11 seconds. (Normally a spray time of up to 20 seconds was required with prior production lubricant.)

One shift was run with 2:1 (water:lubricant) dilution described above. The test was continued for a second shift with additional dilution of 3:1. Load cells mounted on the press to monitor press loads indicated even lower press loads.

EXAMPLE 2

In this example, suitable grades of hydroxy ethyl cellulose were slowly dissolved in water to give a mucilage having a Brookfield viscosity of between 1500 and 2000 cps. A pre-weighed amount of 50% sodium hydroxide was then added to the solution with vigorous agitation.

A stoichiometric amount of trimellitic anhydride was then slowly sifted into the reacting solution with agitation. The reaction, thus, resulting in a clear solution of trisodium trimellitate or a trisodium salt of trimellitic acid.

To this solution was added a suitable biocide preservative and a small amount of a coloring agent. The final product was a transparent, clear green solution having a pH of 9.0 and a Brookfield viscosity of 1500 cps at 72° F.

The formulation of the composition is as follows:

| Ingredient | % by Weight |
|---|---|
| Trimellitic Anhydride | 11.00 |
| Sodium Hydroxide (50%) - Caustic Soda | 15.00 |
| Hydroxy Ethyl Cellulose (Natrosol 250 HR 0.5%) (Natrosol 250 MR 0.4%) | 0.90 |
| Biocide (Triadine 10 - Olin Chemical Co.) | 0.20 |
| Water | 72.89 |
| Green Dye | .01 |
| | 100.00 |

The above composition was used in a test for hot forging of powdered metal preform on a mechanical press. The test part was a transmission gear suitable for use in cars with cruise control. The composition was diluted 4:1 (water:lubricant) and spray applied. Approximately 500 test parts were made with no failure of the lubricant.

The test parameters were as follows:

1. Preform temperatures prior to forging were 1750° F. and were coated with Deltaforge 81 (a graphite aqueous dispersion forging lubricant) and overcoated with Glydag B to prevent decarburization and to provide additional lubrication.
2. The die temperatures ran from 300° F. to 400° F.

EXAMPLE 3

In this test a 50% solution of sodium hydroxide was blended with a stoichiometric amount of trimellitic anhydride to yield trisodium trimellitate (a trisodium salt of benzene 1,2,4-tricarboxylic acid) and water.

Hydroxyl ethyl cellulose modifiers were then added along with a suitable biocide preservative and a coloring agent.

The resulting producing was a transparent, blue solution having a pH of approximately 8.

The formulation of the composition is as follows:

| Ingredient | % by Weight |
|---|---|
| Trimellitic Acid (Anhydride) | 10.70 |
| Sodium Hydroxide | 6.67 |
| Hydroxy Ethyl Cellulose | 1.24 |
| Biocide (Grotan BK - Lehn & Fink Co.) | 0.17 |
| Blue Dye | 0.01 |
| Water | 81.22 |
| | 100.00 |

The above lubricant was blended 9:1 (water:lubricant). The blend was tested by spray applying it to the lower die on a 1600 ton hydraulic forging press being used for hot forging gears. The temperature of the die was 446° F. to 482° F. The test billets were S45C steel, weighing 1.4 kilograms. The press cycle was 20 per minute. The lubricant of this invention showed better wetting properties and an increase in die-life of 30% as compared with a sodium fumarate-based lubricant of the type disclosed in Kratzer U.S. Pat. No. 4,401,579.

EXAMPLE 4

In this example, stoichiometric amounts of 50% sodium hydroxide and trimellitic anhydride were reacted in an open vessel to give a solution of trisodium mellitate in water.

To this solution was added an organic thickener, a suitable biocide preservative and a small amount of a coloring agent. The final product was a transparent, clear blue solution and pH was adjusted to about 6.5 to 7.

The formulation of the composition is as follows:

| Ingredient | Parts by Weight |
|---|---|
| Water Blue 2G | 0.005 |
| Natrasol HHR | 0.5 |
| Natrasol MR | 0.5 |
| NaOH (50%) | 15.35 |
| Trimellitic Acid Anhydride | 12.5 |
| Grotan (Lehn & Fink Co.) - Biocide | 0.17 |
| Water | 71. |
| | 100.025 |

The above composition was used in a hot forming test of billet metal on a mechanical press. The test part was a crutch piston. The composition was diluted 10:1 (water:lubricant) and spray applied. Circular lines appeared on the base of the parts formed indicating insufficient lubricating.

The test parameters were as follows:

1. Billet (material: S35C; weight: 670 gm; shape: 44 mm diameter bar, 56 mm long) temperatures prior to forming were 1000° C. (1832° F.).
2. The die temperatures ran from 120° C. to 220° C. (248°–428° F.). The dies were sprayed with the above composition prior to forming.

EXAMPLE 5

Graphite, in the amount of 0.8%, was added to the composition of Example 4 and diluted to a ratio of 10:1 (water:lubricant). The forming of the test crutch piston was continued. Approximately 2,000 test parts were made with no apparent failure of the lubricant even using used dies which had been polished with sandpaper. The test parameters were the same as in Example 4.

EXAMPLE 6

A phosphate ester (GAFAC LP 700) in the amount of 4% by weight, was added to the composition of Example 4 and diluted to a ratio of 13:1 (water:lubricant). The forming of test crutch pistons was continued. Approximately 2,000 test parts were formed with no failure of the lubricant, even using used dies which had been polished with sandpaper. The test parameters were the same as in Example 4.

EXAMPLE 7

The composition of Example 4 was used in a hot forging of billet metal on a mechanical press. The test parts were cranks for motorcycles. The composition was diluted 10:1 (water:lubricant) and spray applied. Approximately 8,500 test parts were formed with no apparent failure of the lubricant.

The test parameters were as follows:

1. Billet (material: S48C steel; shape: 36 mm diameter bar, 75 mm long) temperatures prior to forging were 1000° C. (1832° F.).
2. The die temperatures ran from 360° C. to 420° C. (680°–788° F.). The dies were sprayed with the above composition prior to forging.

For the following examples the formulation of the composition is set forth in tabular format:

| | Parts by Weight | | | | |
|---|---|---|---|---|---|
| Ingredients | Ex. 8 | Ex. 9 | Ex. 10 | Ex. 11 | Ex. 12 |
| Water Blue 2G | 0.005 | 0.005 | 0.005 | 0.005 | 0.005 |
| Natrasol HHR | 0.5 | 0.5 | 0.5 | 0.5 | 0.5 |
| Natrasol MR | 0.5 | 0.5 | 0.5 | 0.5 | 0.5 |
| NaOH (50%) | 15.35 | 15.35 | 15.35 | 15.35 | 15.35 |
| Trimellitic Acid Anhydride | 12.5 | 12.5 | 12.5 | 12.5 | 12.5 |
| Phosphate Ester (GF-361) | 4.0 | — | — | 2.0 | — |
| Phosphate Ester (LE-700) | — | 4.2 | — | — | 1.8 |
| Phosphate Ester (RM-510) | — | — | 3.0 | — | — |
| Grotan (Lehn & Fink Co.) | 0.17 | 0.17 | 0.17 | 0.17 | 0.17 |
| Water | 71. | 71. | 71. | 71. | 71. |

The invention herein also encompasses that when the trimellitic acid salt is used in combination with the organic thickening agent, there should be less than 4% by weight of any other aliphatic polycarboxylic acid salt present in the salt reaction product.

Still another unique aspect of the invention, is the discovery that the inclusion of the phosphate ester material provides an inventive composition of polycarboxylic acid salt material, water dispersible thickening agent, phosphate ester extreme pressure additive, and water to give a lubricant composition having excellent overall technical advantages. The polycarboxylic acid salt material in this latter instance can be selected from the group of trimellitic acid, fumaric acid, adipic acid, and phthalic acid, but preferably is trimellitic acid.

While it will be apparent that the preferred embodiments of the invention disclosed are well-calculated to fulfill the objects stated above, it will be appreciated that the invention is susceptible to modification, variation, and change without departing from the proper scope or fair meaning of the subjoined claims.

What is claimed is:

1. A water-base lubricant composition suitable for use in elevated temperature metal forming operations consisting of:

(a) about 1% to about 40% by weight of a trimellitic acid salt reaction product of trimellitic acid and an alkali metal or alkali earth metal hydroxide such that the pH of the composition is about 6.5 to about 10; and said reaction product containing zero to less than 4% by weight of any other aliphatic carboxylic acid salt, (b) about 0.1% to about 12% by weight of a water dispersible organic thickening agent;

(c) about 0.01% to about 22% by weight of an extreme pressure additive;

(d) about 0.01% to about 2% by weight of a biocidal agent;

(e) about 0.01% to about 10% by weight of a performance enhancer material; and (f) the balance water.

2. The composition according to claim 1 wherein, said organic thickening agent is selected from the group consisting of methyl cellulose, ether cellulose, carboxy methyl cellulose, ammonium carboxyethyl cellulose, hydroxymethyl cellulose, hydroxyethyl cellulose, carboxypropyl cellulose, casein, alginates, polymethacrylates, polyvinyl alcohol, starch, gelatin, gum arabic, polysaccharides, and mixtures thereof.

3. The composition according to claim 1 wherein, said extreme pressure additive is selected from the group consisting of molybdenum disulfide, graphite, boron nitride, talc, calcium carbonate, mica, magnesium oxide, phosphate esters, sulfurized fatty acids, phospho-sulfurized vegetable oils, metallic soaps, alkali stearates, alkali oleates, and dipolyethylene oxide phosphate, and mixtures thereof;

said extreme pressure additive being present in the range of about 0.01% to about 22% by weight.

4. The composition according to claim 1 wherein, said extreme pressure additive is a phosphate ester material, wherein said phosphate ester extreme pressure additive has the following properties:

a specific gravity of about 1 to about 1.7, an acid number of about 30 to about 200, a maximum % phosphorous of about 1 to about 16.

5. The composition according to claim 1 wherein, said performance enhancer material is selected from the group consisting of sodium nitrite, sodium nitrate, alkali-metal silicates, alkali-metal borates, alkali-metal metaborates, alkali-metal chlorides, alkali-metal fluorides, ammonium phosphates, alkali-metal polyphosphates, ammonium acetate, ammonium citrate, sodium benzoate, and mixtures thereof.

6. The composition according to claim 1 wherein, said biocidal agent is selected from the group consisting of polyamino derivatives, triazine derivatives, and mixtures thereof; and said biocidal agent is present in the range of about 0.01% to about 2% by weight.

7. The composition according to claim 1 wherein, said alkali metal hydroxide is sodium hydroxide.

8. A process of forging ferrous or non-ferrous metals, comprising the steps of:

contacting the forging dies with an effective lubricating amount of the composition described in claim 1, closing the dies to forge the metal, opening the dies, and removing the forging.

9. A process of forging ferrous or non-ferrous metals, comprising the steps of:

contacting the workpiece with an effective lubricating amount of the composition described in claim 1, closing the dies to forge the metal, opening the dies, and removing the forging.

10. A process for forging ferrous or non-ferrous metals, comprising the steps of:

contacting the forging dies with an effective lubricating amount of the composition described in claim 4 and forming the metal.

11. A process of forming ferrous or non-ferrous metals, comprising the steps of:

contacting the metal workpiece to be formed with an effective lubricating amount of the composition described in claim 3 and forming the metal workpiece.

* * * * *

UNITED STATES PATENT AND TRADEMARK OFFICE

CERTIFICATE OF CORRECTION

PATENT NO. : 4,765,917

DATED : August 23, 1988

INVENTOR(S) : Otaki, Shiro et al

It is certified that error appears in the above-identified patent and that said Letters Patent is hereby corrected as shown below:

Column 4, line 1 ,
"ether" should be --ethyl--

Column 4, line 2,
"ether" should be --ethyl--

Column 9, line 26, Claim 2.

"ether" should be --ethyl--

Signed and Sealed this

Fourteenth Day of March, 1989

*Attest:*

DONALD J. QUIGG

*Attesting Officer*

*Commissioner of Patents and Trademarks*